US005186518A

United States Patent [19]

Pine

[11] Patent Number: 5,186,518

[45] Date of Patent: Feb. 16, 1993

[54] CARRIAGE MECHANISM FOR A GLIDER/THREE-WAY RECLINER CHAIR HAVING REAR DRIVE LINK AND REAR OTTOMAN LINK

[75] Inventor: James J. Pine, Tupelo, Miss.

[73] Assignee: DBJU, Inc., Verona, Miss.

[21] Appl. No.: 748,262

[22] Filed: Aug. 21, 1991

[51] Int. Cl.[5] ..... A47C 1/02

[52] U.S. Cl. ..... 297/85

[58] Field of Search ..... 297/85, 83, 90

[56] References Cited

U.S. PATENT DOCUMENTS

| | | | |
|---|---|---|---|
| 3,433,527 | 3/1969 | Re | 297/85 |
| 3,550,952 | 12/1970 | Ferguson | 297/85 |
| 3,756,651 | 9/1973 | Sloan | 297/85 |
| 4,194,783 | 3/1980 | Cycowicz et al. | 297/88 |
| 4,306,746 | 12/1981 | Crum | 297/85 |
| 4,418,957 | 12/1983 | Rogers, Jr. | 297/85 |
| 4,544,201 | 10/1985 | Rogers, Jr. . | |
| 4,591,205 | 5/1986 | Jamas | 297/85 |
| 4,863,215 | 9/1989 | Crum | 297/85 |
| 4,915,444 | 4/1990 | Rogers, Jr. | 297/85 X |
| 4,989,914 | 2/1991 | Pine | 297/85 |

*Primary Examiner*—José V. Chen

*Assistant Examiner*—James M. Gardner

*Attorney, Agent, or Firm*—Watson, Cole, Grindle & Watson

[57] ABSTRACT

A carriage mechanism for supporting the frame, seat, backrest, legrest and footrest of a glider/three-way recliner chair includes mirror-image right and left support assemblies connected by a torque tube, each support assembly including a base subassembly which provides front and rear mounting points and a main linkage subassembly which is suspended from these front and rear mounting points, the main linkage subassembly including front and rear scissor links which are pivotally connected, a mounting plate for attachment to a seat frame, a backrest support flange, a rear drive link and a rear ottoman link. Each main linkage subassembly is capable of moving in a forward and rearward gliding motion relative to a flooring surface when the support assembly is in a retracted condition and in a forward and rearward motion which is parallel to the flooring surface when the support assembly is in an intermediate extended condition. Such parallel motion will tend to stop due to gravity, thus obviating the need for a positive locking linkage.

12 Claims, 7 Drawing Sheets

47
44
59
57
D1
28
F
51a
23
58b
25
56b
24
LS
S
4
6

CARRIAGE MECHANISM FOR A GLIDER/THREE-WAY RECLINER CHAIR HAVING REAR DRIVE LINK AND REAR OTTOMAN LINK

BACKGROUND OF THE INVENTION

1. Field of the Invention

The present invention relates to glider/three-way recliner chairs, and more particularly to the carriage mechanisms thereof which support the seat, backrest, footrest and legrest of the chairs above a flooring surface and enable the chairs to operate in the desired fashion.

2. The Prior Art

Glider/three-way recliner chairs are well known in the furniture industry. The carriage mechanisms in such chairs support the frame, seat, backrest, footrest and legrest above a flooring surface and enable the chairs to operate as desired, i.e., to either be in an upright state (the carriage mechanism being in a retracted condition), during which the chair can be moved by an occupant in a gliding forward and rearward fashion, or be converted to an "open" state (the carriage mechanism shifting to an intermediate extended condition), during which any gliding movement of the chair will be stopped, or be converted to a reclined state (the carriage mechanism shifting to a fully extended condition). Such glider/three-way recliner chairs are very desirable because the seats thereof do not move more than a few inches upwardly or downwardly relative to the flooring surface during gliding movement, thus reducing the likelihood that an occupant's feet will be lifted off the flooring surface during use (as can occur with rocker/recliner chairs).

Unfortunately, glider/three-way recliner chairs have not been as popular with consumers as rocker/recliner chairs. This is because currently available glider/three-way recliner chairs do not always operate in a satisfactory fashion. Characterized by a complicated construction and the use of a large number of link elements, the carriage mechanisms thereof do not always shift to an extended condition (open state of the chair) or a fully extended condition (reclined state of the chair) properly. In this regard, if an occupant attempts to convert the chair into an open state when the chair is at a rearward point during its gliding motion, the carriage mechanism will shift to its intermediate extended condition at a very high angle, and if the chair is then converted to a reclined state, the occupant's weight will tend to cause the chair to tip over backwardly. Or if the chair is converted to an open state at certain other points along its glide path (other than its rest point), the carriage mechanism will jam in a partially extended condition and will not shift to its fully extended condition. In this event, an occupant's only recourse is to return the chair to an upright state and to start again. These are serious disadvantages to the desirability of owning currently available glider/three-way recliner chairs.

It should also be mentioned that currently available carriage mechanisms for glider/three-way recliner chairs utilize many linkage elements, in part because they require the use of positive locking linkages to prevent the chairs from gliding when opened or reclined. The elimination of such positive locking linkages would be a distinct advantage, both in reducing costs and in reducing the chances that carriage mechanism failure can occur.

OBJECTS OF THE INVENTION

It is an object of the present invention to provide a carriage mechanism for a glider/three-way recliner chair which is improved in construction as compared to the carriage mechanisms currently available.

More specifically, it is an object of the present invention to provide a carriage mechanism for a glider/three-way recliner chair which is simple in design and construction, which uses fewer link elements than the currently available carriage mechanisms (indeed fewer link elements than the carriage mechanisms of currently popular rocker/recliner chairs), and which does not need or utilize any positive locking linkages in order to stop the gliding movement of the chair when the chair is converted to an open state, but which will achieve such a result using only the same link elements which provide the gliding movement and enable the carriage mechanism to shift to its extended conditions.

It is also an object of the present invention to provide an improved glider/three-way recliner chair which utilizes such an improved carriage mechanism.

SUMMARY OF THE INVENTION

According to the present invention, the carriage mechanism includes mirror-image left and right support assemblies which are operatively interconnected by a torque tube, each of the support assemblies including a base subassembly providing bracket means defining two spaced apart mounting points; a main linkage subassembly which is suspended from the two mounting points and which includes a mounting plate for attachment to a chair seat frame and a backrest support flange for attachment to a backrest frame; and an extendable footrest-legrest subassembly connected to the main linkage subassembly; the main linkage subassembly being capable of moving in a gliding motion relative to a flooring surface when the support assembly is in its retracted condition and moving in a motion which is parallel to the flooring surface when the support assembly is shifted to its intermediate extended condition, such parallel motion tending to stop due to gravity. Neither the left nor the right support assemblies utilize a locking linkage to positively stop forward or rearward motion when the assemblies (and thus the carriage mechanism as a whole) are in their intermediate extended conditions.

Further features and advantages of the invention will become apparent from the attached drawings, taken in conjunction with the following discussion.

DETAILED DESCRIPTION OF THE DRAWINGS

Figure 12:
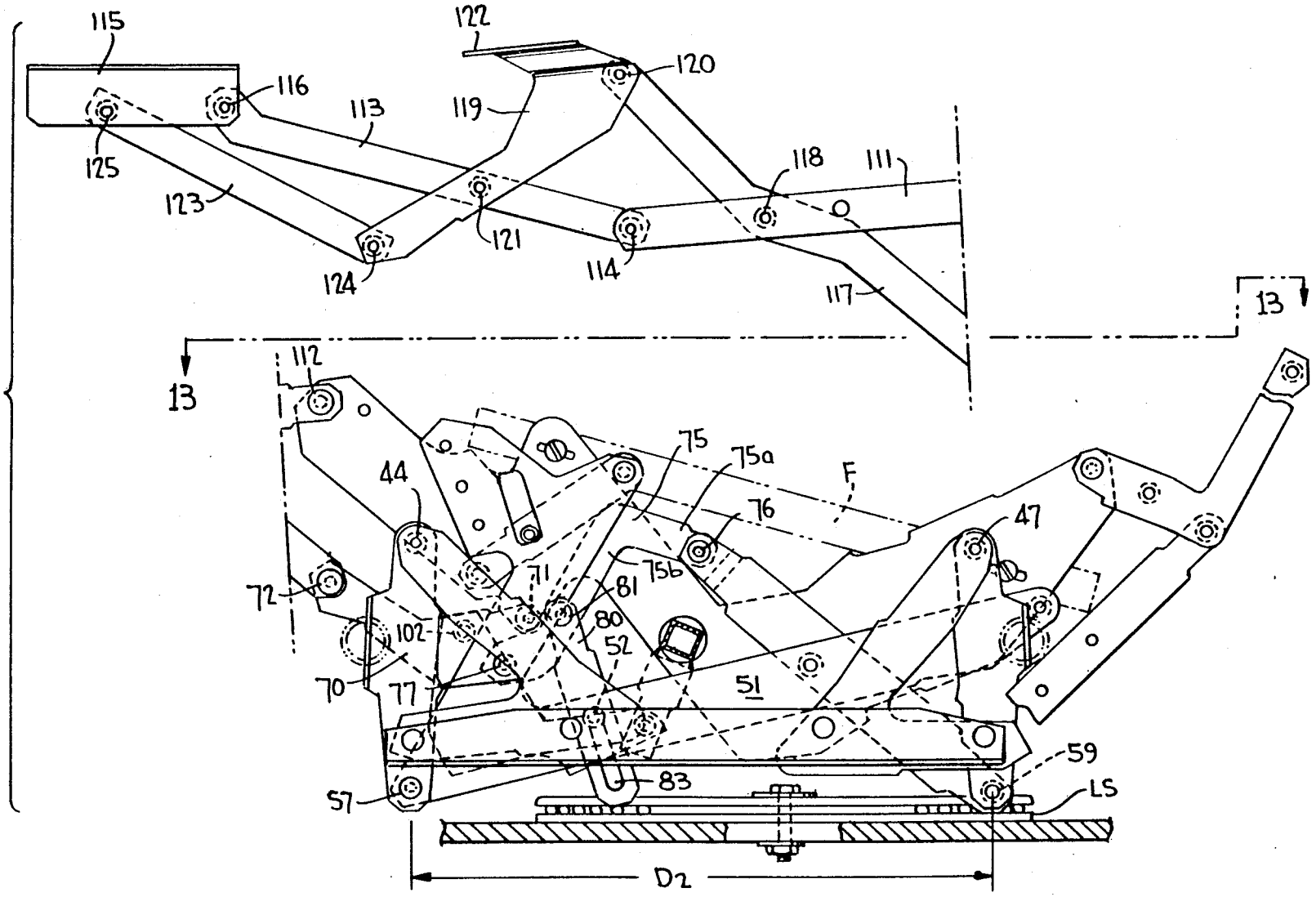
FIG. 12 is an elevational left side view of the right support assembly of FIG. 1 when in its intermediate extended condition (corresponding to an open state of a supported glider/three-way recliner chair)
Figure 13:
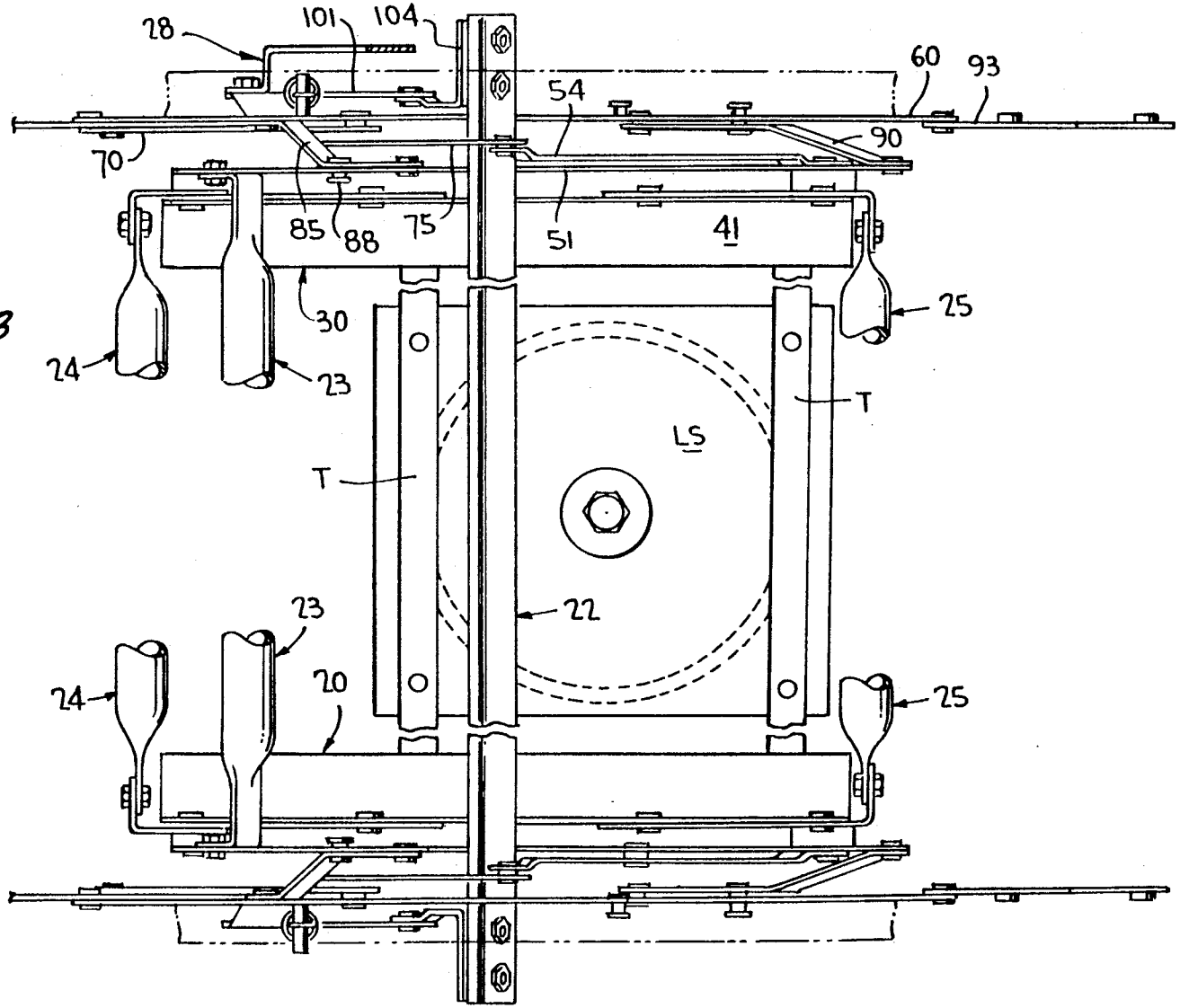
FIG. 13 is a partial top plan view of the inventive carriage mechanism which includes the right support assembly depicted in FIG. 12.

A carriage mechanism for a glider/three-way recliner chair according to a preferred embodiment of the present invention is depicted in FIGS. 1, 2, 4–10, 12, 13 and 15. As best shown in FIG. 13, it includes a left support assembly 20, a right support assembly 30, a torque tube 22 which extends between the left and right assemblies, stabilizer tubes 23, 24, 25 which are interconnected between the assemblies, and an actuating lever 28, which in this embodiment is connected to the toggle drive subassembly of the right support assembly. The left support assembly is constructed as a mirror image of the right support assembly, such that a description of the elements and operation of the right support assembly will suffice to describe the elements and operation of the left support assembly. In the following description of the right support assembly 30, the terms outer and outwardly relate to relative location or side opposite (facing or extending away from) the left support assembly 20 and the terms inner and inwardly will relate to the location or side towards (facing or extending towards) the left support assembly 20, while the terms front or forwardly and rear or rearwardly will relate to an orientation relative to a chair in which the carriage mechanism is utilized.

Figure 2:
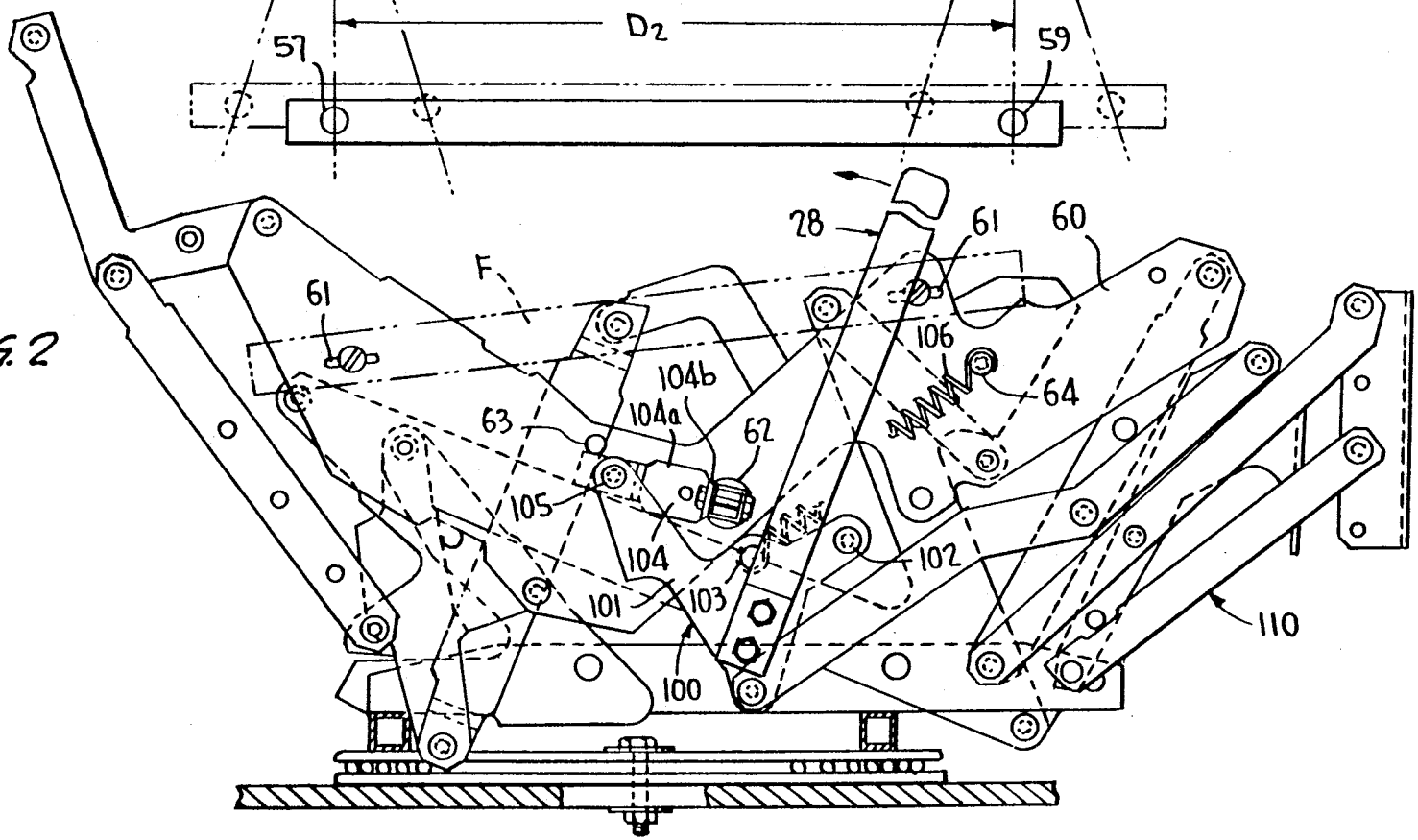
FIG. 2 is an elevational right side (outside) view of the right support assembly of FIG. 1.
Figures 7, 8, 9:
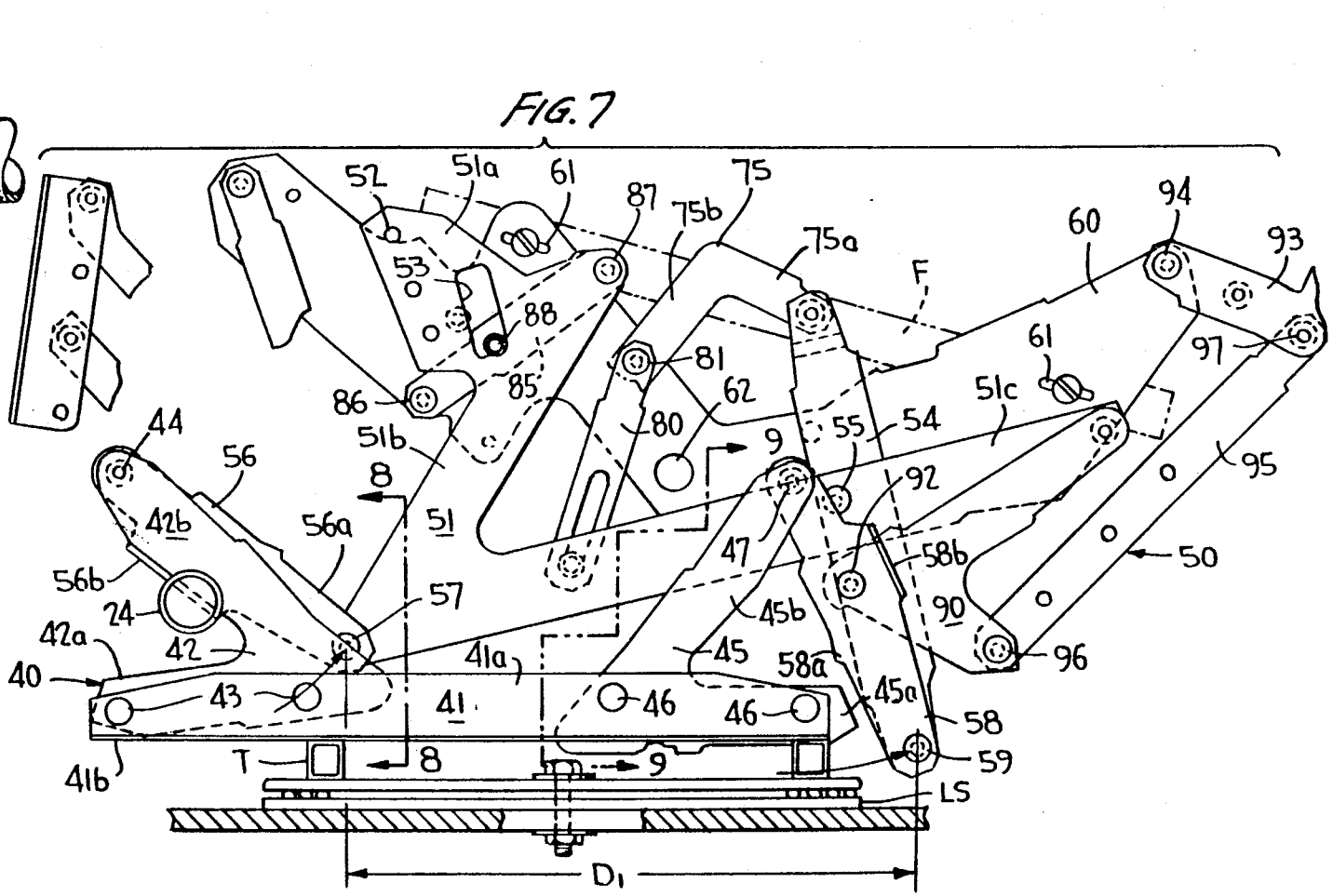
FIG. 7 is elevational left side view of the right support assembly of FIG. 1 (still in a retracted condition) when at its rearward-most glide position.
FIG. 8 is a view of FIG. 7 as seen along line 8—8.
FIG. 9 is a view of FIG. 7 as seen along line 9—9.

As best seen in FIGS. 2 and 7, the right support assembly 30 includes a base subassembly 40, a main linkage subassembly 50, a toggle drive subassembly 100, and a footrest-legrest subassembly 110. The elements of each of these subassemblies will now be described.

The base subassembly 40 includes a mounting rail 41 which has a vertical flange 41*a* and a horizontal flange 41*b*. The horizontal flange includes holes through which bolts B can extend to fixedly attach the mounting rail to the ends of support tubes T mounted on lazy Susan assembly LS (the lazy Susan assembly enables the carriage mechanism, and thus a supported glider/three-way recliner chair as a whole, to rotate about the vertical axis of the lazy Susan assembly). The base subassembly also includes a front bracket 42 and a rear bracket 45. The front bracket, which is generally V-shaped, has one leg 42*a* fixedly attached to the vertical flange 41*a* by rivets 43 while the upper end of the other leg 42*b* supports an outwardly-extending mounting pin 44. The rear bracket, which is also generally V-shaped, has one leg 45*a* fixedly attached to the vertical flange 41*a* by rivets 46 and the upper end of its other leg 45*b* supports an outwardly-extending mounting pin 47. These mounting pins 44 and 47 constitute fixed-distance mounting points from which the main linkage subassembly is suspended.

The main linkage subassembly 50 includes a large, generally V-shaped front scissor link 51 and a rear scissor link 54, the front scissor link being shaped to provide a head portion 51*a*, a downwardly and forwardly-extending middle portion 51*b*, and a rearwardly-extending tail portion 51*c*. The rear scissor link is elongated and rotatably connected to the tail portion of the front scissor link at pivot pin 55. The head portion of the front scissor link includes holes 52 through which bolts can extend to connect the head portion to an end of stabilizer tube 23 (see FIGS. 6 and 13), the other end of the stabilizer tube being similarly attached to a head portion of a front scissor link of the corresponding main linkage subassembly of the left support assembly (see FIG. 13).

A front swing link 56, which has a vertical flange 56*a* and an inwardly-extending transverse flange 56*b*, has its vertical flange positioned outwardly of the leg 42*b* of the front bracket 42 and inwardly of the front scissor link 51, and its transverse flange in front of the leg 42*b*. Its upper end is pivotally attached to the mounting pin 44 and its lower end is pivotally connected by a pivot pin 57 to the front scissor link where its portions 51*b* and 51*c* merge. The transverse flange 56*b* includes holes through which bolts extend to connect to an end of stabilizer tube 24 (see FIGS. 4, 8 and 13), the other end of the stabilizer tube being similarly attached to a transverse flange of a front swing link of the corresponding main linkage subassembly of the left support assembly (see FIG. 13). The transverse flange 56*b* also functions as a glide stop when it contacts the front edge of the leg 42*b* of the front bracket at a rearward-most point of the glide motion of the main linkage subassembly as shown in FIG. 7.

Figure 10:
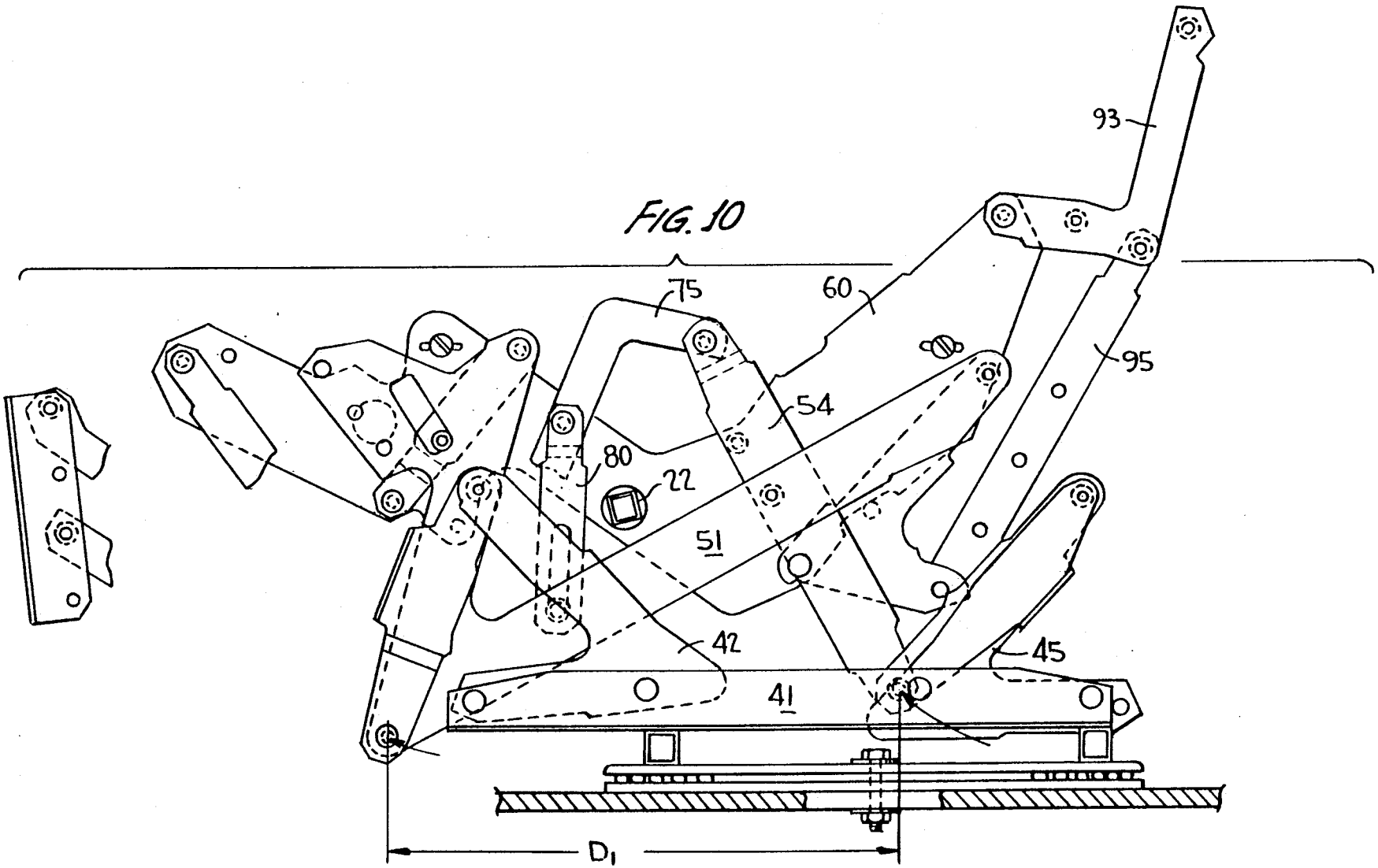
FIG. 10 is an elevational left side view of the right support assembly of FIG. 1 (still in a retracted condition) when at its forward-most glide position, FIG. 11 schematically depicts the corresponding gliding movement of a glider/three-way recliner chair which utilizes a carriage mechanism according to the present invention.

A rear swing link 58, which has a vertical flange 58*a* and an inwardly-extending transverse flange 58*b*, has its vertical flange positioned outwardly of the leg 45*b* of the rear bracket 45 and inwardly of the rear scissor link 54, and its transverse flange rearwardly of the leg 45*b*. Its upper end is pivotally connected to the mounting pin 47 and its lower end is pivotally connected to the lower end of the rear scissor link by pivot pin 59. The transverse flange 58*b* includes holes through which bolts extend to connect to an end of stabilizer tube 25 (see FIGS. 5, 9 and 13), the other end of the stabilizer tube being similarly attached to a transverse flange of a rear swing link of the corresponding main linkage subassembly of the left support assembly (see FIG. 13). The transverse flange 58*b* also functions as a glide stop when it contacts the rear edge of the leg 45*b* of the rear bracket at a forward-most point of the glide path of the main linkage subassembly as shown in FIG. 10.

The main linkage subassembly also includes an angular, flat mounting plate 60 which is positioned outwardly of the front and rear scissor links and which includes slots 61 at locations along its length to enable it to be connected by suitable screws to the right side frame element F of a chair seat. It also includes an opening 62 through which the torque tube 22 rotatably extends, a stop pin 63 which extends outwardly thereof (see FIG. 2) and a stud 64 which also extends outwardly thereof. The stop pin 63 and the stud 64 cooperate with the toggle drive subassembly as will be discussed below.

A rear ottoman link 70, a drive link 75 and a sequencing link 80 are positioned outwardly of the front and rear scissor links and inwardly of the mounting plate. The rear ottoman link 70 (see FIGS. 12 and 13) has a somewhat curved shaped and is pivotally attached at its rear end to the mounting plate at pivot pin 71, whereas it mounts a pivot pin 72 at its front end for attachment of the footrest-legrest subassembly. The rear drive link 75, which is L-shaped, has its short leg 75*a* pivotally attached to the upper end of the rear scissor link by pivot pin 76 and the end of its (downwardly-extending) long leg 75*b* pivotally attached to the rear ottoman link at pivot pin 77. The sequence link 80 is pivotally mounted at its upper end to the long leg 75*b* of the drive link 75 by pivot pin 81 and it includes an elongated slot 83 to enable it to move about guide pin 52 which extends outwardly from the tail portion 51*c* of the front scissor link 51.

A recline stop link 85 (see FIG. 7) which is located outwardly of the front scissor link and inwardly of the mounting plate is pivotally mounted at its front end to the mounting plate at pivot pin 86 and at its rear end to the head portion 51*a* of the front scissor link at pivot pin 87. Extending inwardly from this recline stop link is a stop pin 88 which is movable in a slot 53 in the head portion 51*a* of the front scissor link.

Finally, a control link 90, which is somewhat V-shaped and positioned outwardly of the tail portion 51*c* of the front scissor link 51 and inwardly of mounting plate 60, is pivotally attached at the free end of one leg thereof to the free end of the tail portion 51*c* of the front scissor link by a pivot pin 91 and at an intersection of its legs to the mounting bracket by a pivot pin 92. An L-shaped backrest support flange 93 is pivotally attached at a free end of its short leg to the upper rear end of the mounting plate by a pivot pin 94, and a rectiliner tilt link 95 is pivotally connected at its lower end to the free end of the other leg of the control link at pivot pin 96 and at its upper end to the L-shaped backrest support flange at pivot pin 97.

Turning now to the toggle drive assembly 100, which is positioned outwardly of the mounting plate, as shown in FIG. 2 it includes a front toggle link 101, a rear toggle link 104 and a drive spring 106. The front toggle link is generally V-shaped and is pivotally connected at one of its free ends to the rear ottoman link at pivot pin 102. The rear toggle link is formed to have a vertical leg 104*a* and transverse, outwardly-extending leg 104*b*. The vertical leg is pivotally attached near its free end to the other free end of the front toggle link by pivot pin 105 and the transverse leg includes holes through which bolts pass for attachment to an associated end of the torque tube 22 (see FIG. 13). The drive spring 106 extends from the stud 64 on the mounting plate to a stud 103 extending outwardly from the front toggle link. The stop pin 63 which extends outwardly from the mounting plate 60 is positioned to abut the vertical leg of the rear toggle link and stop upward rotation thereof.

The footrest-legrest subassembly 110, which is of the pantograph or lazy-tong type, includes a first link arm 111 which is pivotally attached at its rear end to the front end of the mounting plate at pivot pin 112, a second link arm 113 whose rear end is pivotally attached to the front end of the first link arm at pivot pin 114 and whose front end is pivotally attached to a footrest support bracket 115 by pivot pin 116, a third link arm 117 whose rear end is pivotally attached to pivot pin 72 on the rear ottoman link 70 and which is pivotally attached along its length to the first link arm at pivot pin 118, a fourth link arm 119 which is pivotally attached to the front and of the third link arm at pivot pin 120 and along its length to the second link arm at pivot pin 121 (the rear end of the fourth link arm being bent inwardly to provide a legrest support bracket 122), and a fifth link arm 123 which is pivotally connected at its opposite ends to the front end of the fourth link arm and to the footrest support bracket 115 by pivot pins 124 and 125, respectively.

The actuating lever 28 is depicted in FIGS. 2 and 13 as connected to the front toggle link 101.

Figures 1, 3, 4, 5, 6:
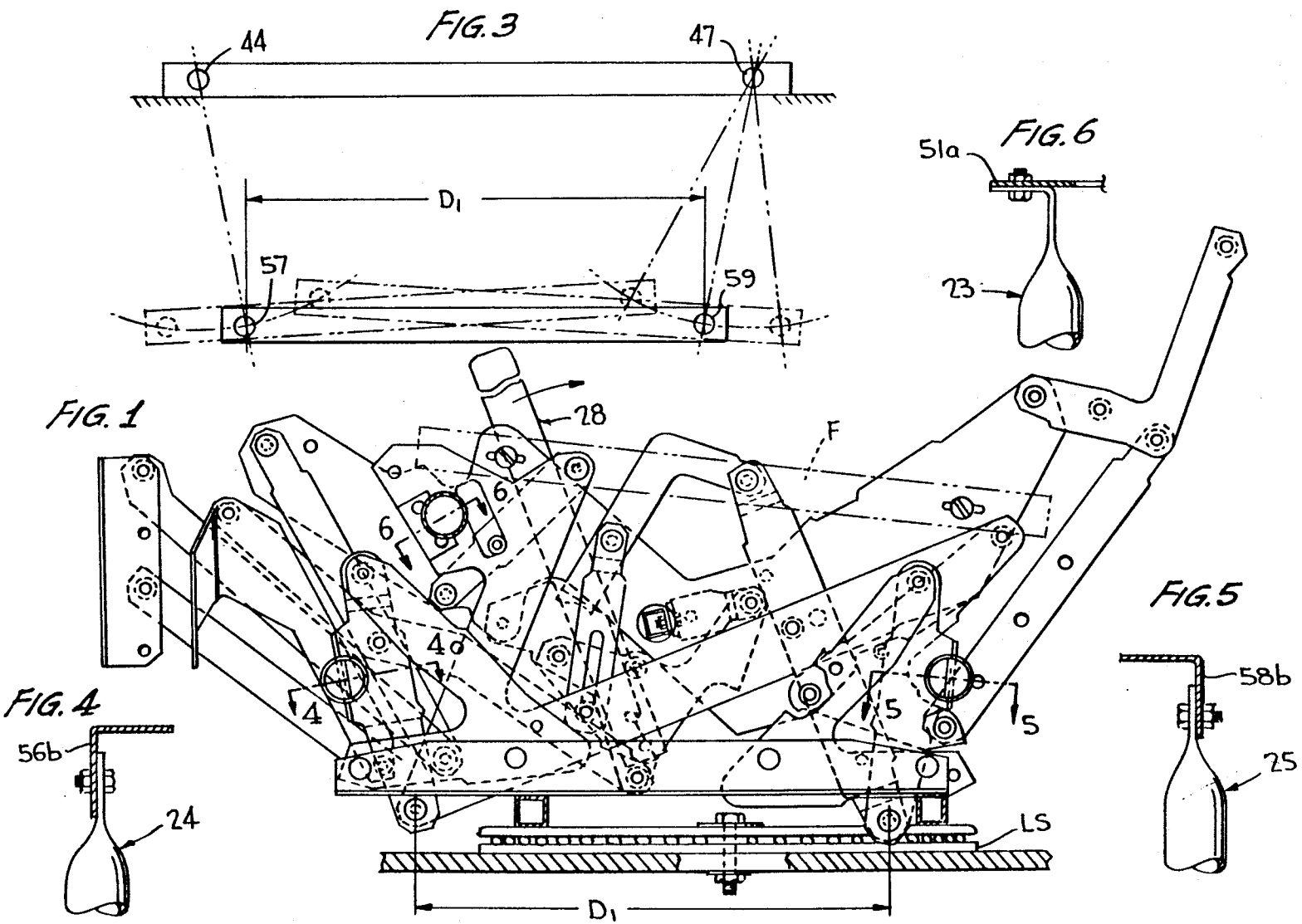
FIG. 1 is an elevational left side (inside) view of a right support assembly of a preferred embodiment of a carriage mechanism for a glider/three-way recliner chair according to the present invention, the assembly being in a retracted and rest condition (corresponding to an upright state of a supported glider/three-way recliner chair)
FIG. 3 is a schematic explanation of how the right support assembly can provide forward and rearward gliding movement relative to a flooring surface when in a retracted condition.
FIG. 4 is a view of FIG. 1 as seen along line 4—4.
FIG. 5 is a view of FIG. 1 as seen along line 5—5.
FIG. 6 is a view of FIG. 1 as seen along line 6—6.
Figure 14:
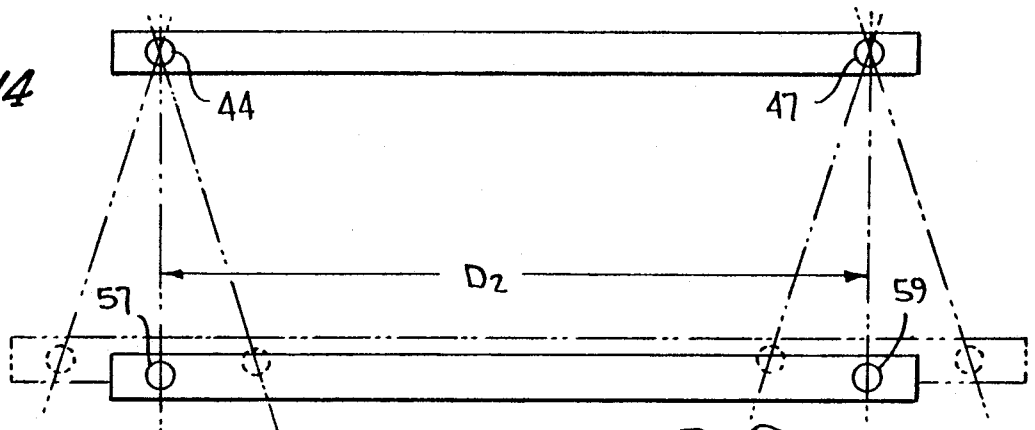
FIG. 14 is a schematic explanation of how the right support assembly of FIG. 12 can provide forward and rearward parallel movement relative to a flooring surface when the assembly is in its intermediate extended condition.
Figures 11, 15, 16:
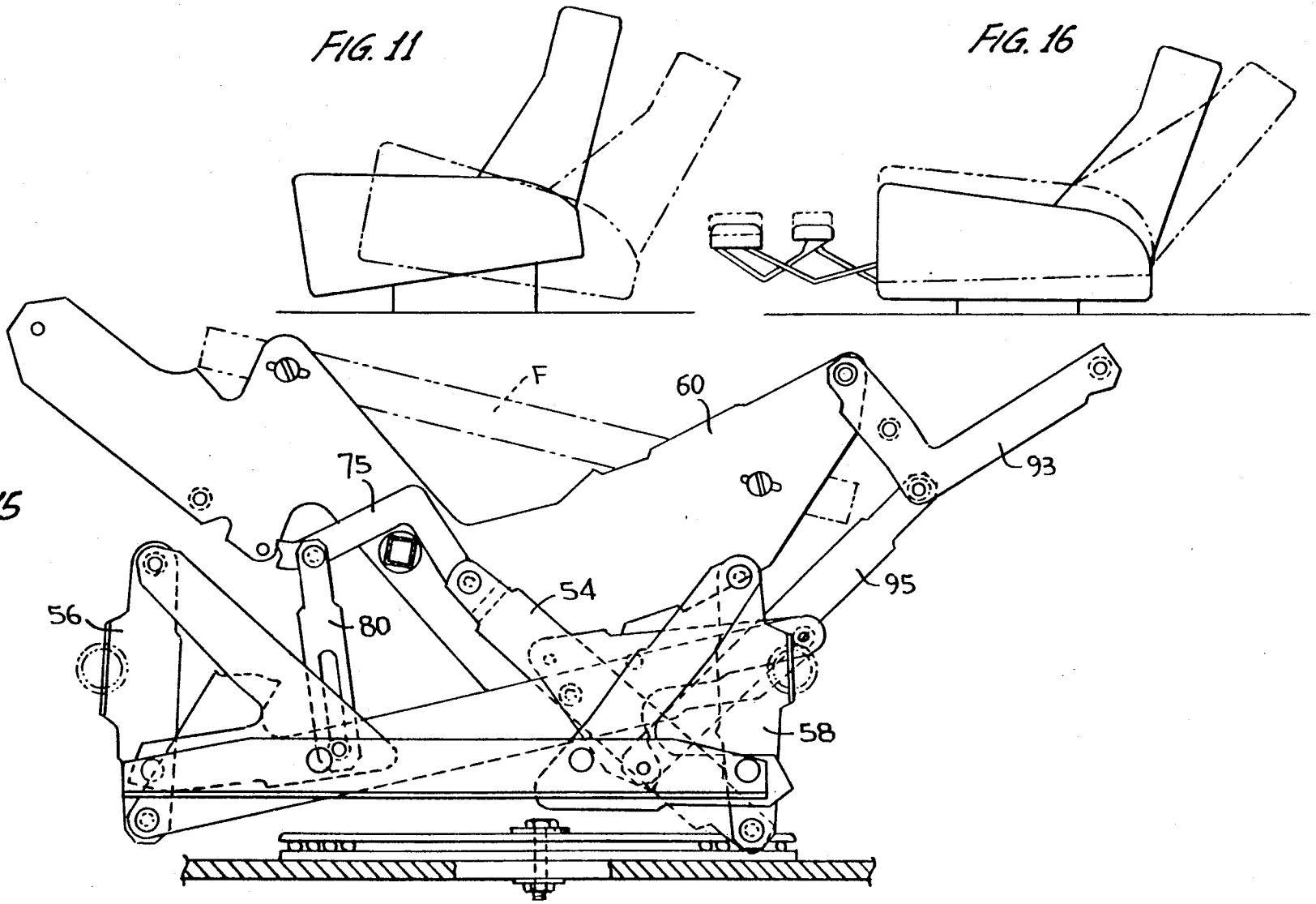
FIG. 15 is an elevational partial left side view of the right support assembly of FIG. 1 when in its fully extended condition (full reclined state of a supported glider/three-way recliner chair), and FIG. 16 schematically depicts a glider/three-way recliner chair according to the invention in its open and reclined states.

The operation of the carriage mechanism will now be described. When the right support assembly 30 is in its retracted condition, the left support assembly will be in its retracted condition, and the carriage mechanism will be in its retracted condition. The glider/recliner chair in which it is employed will be in its upright state. With the right support assembly at its rest position, the elements of the right support assembly will be oriented as shown in FIGS. 1 and 2. The distance $D_1$ between mounting pins 57 and 59 will be less than the fixed distance between the mounting pins 44 and 47, and thus the main linkage subassembly of the right support assembly (and the main linkage subassembly of the left support assembly and thus the chair mounted thereon) will be able to glide forwardly and rearwardly as depicted in FIG. 3, the rearward-most glide point being depicted in FIG. 7 and the forward-most glide point being depicted in FIG. 10. Rearward movement of the activating lever 28 attached to the toggle drive subassembly at any point during the glide movement, such that the front toggle link will be rotated around the pivot pin 102, will cause the rear toggle link to rotate downwardly and away from the stop pin 63 until a point at which the drive spring 106 will forcefully cause the front toggle link to rotate the rear ottoman link 70 about pivot pin 71, thereby moving drive link 75 and scissor links 54 and 51, etc., such that the right support assembly (and, due to the torque tube 22, the left support assembly) will to shift to an intermediate extended condition (open state of the chair). This condition is depicted in FIGS. 12 and 16. This distance between pivot pins 57 and 59 will have increased (due to linkage movement) to a distance $D_2$ equal to that between mounting pins 44 and 47. As shown in FIG. 14, the right (and left) support assemblies will now only be able to move in a parallel fashion to the floor surface and not in a gliding movement as depicted in FIG. 3. Any residual forward/reverse movement of the assemblies (and the supported chair) will tend to stop due to gravity.

When pressure on the backrest support flange 93 is applied by the occupant by leaning back on the backrest, the assembly will shift again into its fully extended condition, thereby resulting in a reclined state of a supported chair. This state is depicted in FIGS. 15 and 16, which show the lifting of the mounting bracket relative to the legrest-footrest subassembly and the backward tilting of the backrest support flange. Reducing pressure on the backrest support bracket by the occupant will cause the support assembly to shift back to its intermediate extended condition, and downward pressure on the footrest support bracket by an occupant's legs will cause the support assembly to be returned to its retracted condition.

Although a preferred embodiment of the invention has now been explained in detail, modifications can be made therein and still full within the scope of the following claims. For example, the actuating lever 28 need not be connected to the front toggle link 101 (inside chair embodiment), but can be connected directly to either end of the torque tube 22 (outside chair embodiment).

I claim:

1. A support assembly for use in a carriage mechanism employed to movably support a frame, seat, backrest, legrest and footrest of a glider/three-way recliner chair above a flooring surface, said support assembly being shiftable between a retracted condition, an intermediate extended condition and a fully extended condition, said support assembly enabling forward and rearward gliding movement of said frame, seat, backrest, legrest and footrest when in its retracted condition and forward and rearward movement in parallel with the flooring surface when in its intermediate extended condition, said support assembly including no locking linkages for positively stopping forward and rearward movement when in its intermediate extended condition, said support assembly comprising a base subassembly which includes bracket means providing front and rear spaced apart mounting points, a main linkage subassembly which is suspended from said front and rear mounting points, and an extendable footrest-legrest subassembly connected to said main linkage subassembly, said main linkage subassembly including a front scissor link; a rear scissor link which is pivotally connected along its length to said front scissor link; a front swing link which is pivotally suspended from said front mounting point and pivotally connected to said front scissor link at a first pivot point below said front mounting point; a rear swing link which is pivotally suspended from said rear mounting point and pivotally connected to said rear scissor link at a second pivot point below said rear mounting point, the distance between the first and second pivot points being less than the distance between said first and second mounting points when said support assembly is in its retracted condition and equal when said support assembly is shifted to its intermediate extended condition; a mounting plate for attachment to a seat frame; a backrest support flange pivotally connected to a rear end of said mounting plate for attachment to a backrest frame; a rear drive link; and a rear ottoman link; said rear drive link being pivotally connected to an upper end of said rear scissor link and to said rear ottoman link and said rear ottoman link being pivotally connected between said mounting plate and said extendable footrest-legrest subassembly, said main linkage subassembly being capable of moving in a forward and rearward gliding motion relative to said flooring surface when said support assembly is in its retracted condition and moving in a forward and rearward motion which is parallel to said flooring surface when the support assembly is in its intermediate extended condition, such parallel motion tending to stop due to gravity.

2. A support assembly according to claim 1, including a toggle drive subassembly connected to said main linkage subassembly to cause the support assembly to shift from its retracted condition to its intermediate extended condition.

3. A support assembly according to claim 2, wherein said toggle drive subassembly is connected to said rear ottoman link to cause said rear ottoman link to rotate, thereby causing said drive link to move and said front and rear scissor links to rotate relative to one another.

4. A support assembly according to claim 3, wherein said toggle drive subassembly includes a front toggle link attached to said rear ottoman link, a rear toggle link pivotally attached to said front toggle link and a drive spring connected between said mounting plate and said front toggle link.

5. A glider/three-way recliner chair which includes a frame, a seat, a backrest, a footrest and a legrest and which includes a carriage mechanism for movably supporting the frame, seat, backrest, footrest and legrest above a flooring surface, said carriage mechanism being shiftable between a retracted condition, an intermediate extended condition and a fully extended condition, said carriage mechanism enabling forward and rearward gliding movement relative to said flooring surface of said frame, seat, backrest, legrest and footrest when in its retracted condition and movement in parallel with the flooring surface when in its intermediate extended condition, said parallel movement tending to stop due to gravity, said carriage mechanism including no locking linkages for positively stopping forward and rearward movement when int is intermediate extended condition, said parallel movement tending to stop due to gravity, said carriage mechanism comprising mirror-image left and right support assemblies, each of said right and left support assemblies including a base subassembly which includes bracket means providing front and rear spaced apart mounting points, a main linkage subassembly which is suspended from said front and rear-mounting points, and an extendable footrest-legrest subassembly connected to said main linkage subassembly, said main linkage subassembly including a front scissor link; a rear scissor link which is pivotally connected along its length to said front scissor link; a front swing link which is pivotally suspended from said front mounting point and pivotally connected to said front scissor link at a first pivot point below said front mounting point; a rear swing link which is pivotally suspended from said rear mounting point and pivotally connected to said rear scissor link at a second pivot point below said rear mounting point, the distance between the first and second pivot points being less than the distance between said first and second mounting points when said support assembly is in its retracted condition and equal when said support assembly is shifted to its intermediate extended condition; a mounting plate for attachment to a seat frame; a backrest support flange pivotally connected to a rear end of said mounting plate for attachment to a backrest frame; a rear drive link; and a rear ottoman link; said rear drive link being pivotally connected to an upper end of said rear scissor link and to said rear ottoman link and said rear ottoman link being pivotally connected between said mounting plate and said extendable footrest-legrest subassembly, said main linkage subassembly being capable of moving in a forward and rearward gliding motion relative to said flooring surface when said support assembly is in its retracted condition and moving in a forward and rearward motion which is parallel to said flooring surface when the support assembly is in its intermediate extended condition, such parallel motion tending to stop due to gravity, and a torque tube operatively interconnected between said left and right support assemblies.

6. A carriage mechanism for movably supporting the frame, seat, backrest, footrest and legrest of a glider/-three-way recliner chair above a flooring surface, said carriage mechanism being shiftable between a retracted condition, an intermediate extended condition and a fully extended condition, said carriage mechanism enabling forward and rearward gliding movement relative to said flooring surface of said frame, seat, backrest, legrest and footrest when in its retracted condition and movement in parallel with the flooring surface when in its intermediate extended condition, said parallel movement trending to stop due to gravity, said carriage mechanism including no locking linkages for positively stopping forward and rearward movement when in its intermediate extended condition, said parallel movement tending to stop due to gravity, said carriage mechanism comprising mirror-image left and right support assemblies, each of said right and left support assemblies including a base subassembly which includes bracket means providing front and rear spaced apart mounting points, a main linkage subassembly which is suspended from said front and rear mounting points, and an extendable footrest-legrest subassembly connected to said main linkage subassembly, said main linkage subassembly including a front scissor link; a rear scissor link which is pivotally connected along its length to said front scissor link; a front swing link which is pivotally suspended from said front mounting point and pivotally connected to said front scissor link at a first pivot point below said front mounting point; a rear swing link which is pivotally suspended from said rear mounting point and pivotally connected to said rear scissor link at a second pivot point below said rear mounting point, the distance between the first and second pivot points being less than the distance between said first and second mounting points when said support assembly is in its retracted condition and equal when said support assembly is shifted to its intermediate extended condition; a mounting plate for attachment to a seat frame; a backrest support flange pivotally connected to a rear end of said mounting plate for attachment to a backrest frame; a rear drive link; and a rear ottoman link; said rear drive link being pivotally connected to an upper end of said rear scissor link and to said rear ottoman link and said rear ottoman link being pivotally connected between said mounting plate and said extendable footrest-legrest subassembly, said main linkage subassembly being capable of moving in a forward and rearward gliding motion relative to said flooring surface when said support assembly is in its retracted condition and moving in a forward and rearward motion which is parallel to said flooring surface when the support assembly is in its intermediate extended condition, such parallel motion tending to stop due to gravity, and a torque tube operatively interconnected between said left and right support assemblies.

7. A carriage mechanism according to claim 6, including a lazy Susan assembly on which the base subassemblies of said left and right support assemblies are fixedly mounted.

8. A carriage mechanism according to claim 6, wherein each of said left and right support assemblies includes a toggle drive subassembly connected to an associated main linkage subassembly to cause the support assemblies to shift from their retracted condition to there intermediate extended condition.

9. A carriage mechanism according to claim 8, wherein the associated toggle drive subassembly is connected to the associated rear ottoman link to cause the rear ottoman link to rotate, thereby causing the drive link to move and the front and rear scissor links to rotate relative to one another.

10. A carriage mechanism according to claim 9, wherein each toggle drive subassembly includes a front toggle link attached to an associated rear ottaman link, a rear toggle link pivotally attached to said front toggle link, and a drive spring connected between an associated mounting plate and an associated front toggle link.

11. A carriage mechanism according to claim 10, including an actuating lever attached to the front toggle link of one of said toggle drive subassemblies.

12. A carriage mechanism according to claim 11, wherein opposite ends of said torque tube are connected to the rear toggle link of the toggle drive subassemblies of said respective left and right support assemblies.

* * * * *